US008631751B2

(12) United States Patent
Lonati et al.

(10) Patent No.: US 8,631,751 B2
(45) Date of Patent: Jan. 21, 2014

(54) SEWING OR LOOPING HEAD, PARTICULARLY FOR AUTOMATED CLOSING OF TUBULAR KNITTED ARTICLES AT AN AXIAL END THEREOF

(75) Inventors: Ettore Lonati, Botticino (IT); Tiberio Lonati, Brescia (IT); Fausto Lonati, Brescia (IT)

(73) Assignee: Lonati S.p.A., Brescia (IT)

( * ) Notice: Subject to any disclaimer, the term of this patent is extended or adjusted under 35 U.S.C. 154(b) by 585 days.

(21) Appl. No.: 12/994,296

(22) PCT Filed: Mar. 17, 2009

(86) PCT No.: PCT/EP2009/053120

§ 371 (c)(1),
(2), (4) Date: Nov. 23, 2010

(87) PCT Pub. No.: WO2009/144049

PCT Pub. Date: Dec. 3, 2009

(65) Prior Publication Data

US 2011/0073028 A1 Mar. 31, 2011

(30) Foreign Application Priority Data

May 30, 2008 (IT) ..... MI08A1006

(51) Int. Cl.
*D05B 65/00* (2006.01)

(52) U.S. Cl.
USPC ..... 112/294

(58) Field of Classification Search
USPC ..... 112/122, 125, 128, 129, 130, 153, 157, 112/220, 224, 165, 294
See application file for complete search history.

(56) References Cited

U.S. PATENT DOCUMENTS

| | | | | | |
|---|---|---|---|---|---|
| 2,579,059 | A | * | 12/1951 | Vanadia | 112/288 |
| 2,787,231 | A | | 4/1957 | Shoaf | |
| 2,908,154 | A | * | 10/1959 | Butler | 66/140 S |
| 2,997,009 | A | | 8/1961 | Ballard | |
| 3,149,594 | A | | 9/1964 | Buckreus et al | |
| 3,252,438 | A | | 5/1966 | Firestein et al. | |
| 3,710,743 | A | | 1/1973 | Lees | |
| 3,998,172 | A | * | 12/1976 | Marforio | 112/293 |
| 4,020,775 | A | | 5/1977 | King et al. | |
| 4,413,575 | A | * | 11/1983 | Gazzarrini | 112/129 |
| 4,523,535 | A | * | 6/1985 | Blackburn | 112/288 |
| 2004/0020416 | A1 | | 2/2004 | Lonati et al. | |

OTHER PUBLICATIONS

European Patent Office, D. Herry-Martin, International Search Report, completed Aug. 3, 2009, pp. 1-4, EPO, P.B. 5818 Patentlean 2, NL—2280 HV Rijswijk.

* cited by examiner

*Primary Examiner* — Tejash Patel
(74) *Attorney, Agent, or Firm* — Husch Blackwell LLP

(57) ABSTRACT

A sewing or looping head, particularly for the automated closing of tubular knitted articles at one of their axial ends comprising a pair of sewing elements, which can move along corresponding actuation paths and cooperate with each other in forming a sewing chain stitch, and a cutting element, which can be actuated to cut the sewing chain stitch; in the sewing or looping head, the cutting element can engage the sewing chain stitch proximate to the crossing point of the paths of the pair of sewing elements or the point where the sewing chain stitch is formed, so as to minimize the length of the sewing chain stitch that exceeds the length needed to sew or loop the article and so as to reduce the time required to perform the sewing or looping operation.

13 Claims, 5 Drawing Sheets

SEWING OR LOOPING HEAD, PARTICULARLY FOR AUTOMATED CLOSING OF TUBULAR KNITTED ARTICLES AT AN AXIAL END THEREOF

TECHNICAL FIELD

The present invention relates to a sewing or looping head, particularly for the automated closing of tubular knitted articles at an axial end thereof.

BACKGROUND ART

Techniques for performing the automated closing of tubular knitted articles, particularly hosiery items, at an axial end thereof, i.e., the toe in the case of hosiery items, at the end of their production on circular hosiery knitting machines, are known.

Some of these techniques are based on picking up the article, at the end of its production, from the circular hosiery knitting machine and on transferring it to a sewing or looping station, which is generally arranged laterally with respect to the machine used to produce the article.

In the sewing or looping station a sewing or looping head is arranged, by means of which the axial end of the article, usually constituted by the axial end at which the production of the article has ended, is closed.

Some techniques are based on the use of a single device both to pick up the article from the machine that produced it and to support the article during the sewing or looping operation to close its axial end. In other techniques, a device is provided for picking up the article and transferring it to the sewing or looping station and a handling device is provided that is arranged in the sewing or looping station and is used to prepare the article for the subsequent sewing or looping operation and optionally to move the article during sewing or looping with respect to the sewing or looping head.

Usually, the article is picked up from the machine that produced it and optionally transferred to the handling device by engaging individually the loops of knitting of the last row of knitting of the article, and the loops of knitting of a half-row of such last row of knitting are made to face individually the loops of knitting of the other half-row before proceeding with sewing or looping, so that the axial end of the article is closed by joining in each instance two mutually facing loops of the two half-rows that compose the last formed row of knitting. Thanks to this fact, an excellent result is achieved in terms of precision and aesthetics in the automated closing of axial ends of tubular knitted articles, particularly in the automated closing of the toe of hosiery items.

In other techniques for performing automated closing of the toe of hosiery items, the element that supports the article during sewing or looping is constituted by one half of the same needle cylinder of the machine used to produce the article, since at the end of the production of the knitted article one half of the last formed row of knitting is transferred, loop by loop, by means of an appropriately provided element, from the needles that produced it to the needles that have produced, and are still retaining, the loops of knitting of the other half of the same row.

Substantially, the automated closing of an axial end of a knitted article, particularly of hosiery items, is performed by supporting the article by means of a half-ring element provided with a plurality of spikes, which are uniformly spaced one another around the axis of the ring and on each of which two loops of knitting are arranged, one belonging to one half of a row of knitting and one belonging to the other half of the same row of knitting. The sewing or looping head that is used is generally provided with two elements, for example two needles or a needle and a crochet, which cooperate in order to form a sewing chain stitch. One of these two elements, which are actuated synchronously with respect to each other and with respect to the rotary motion of the half-ring about the axis of the ring, enters with its spike, in each instance, in a pair of loops of knitting that is carried by a same spike of the half-ring element so that the sewing chain stitch progressively ties together the several pairs of loops, thus closing the axial end of the knitted article.

These sewing or looping heads can generally move toward and away from the half-ring that supports the article to be sewn or looped, so that they are closer to the half-ring during the sewing or looping operation and are spaced when they are inactive, so as to avoid causing hindrance during the operation for transferring the loops of knitting onto the spikes of the half-ring and during the operation for removing the article at the end of sewing or looping. Moreover, these sewing or looping heads are equipped with a cutting element to cut the sewing chain stitch at the end of the sewing or looping operation.

The cutting elements with which these sewing or looping heads are equipped are generally arranged downstream of the region where the sewing chain stitch forms along the direction of rotation of the half-ring that supports the article during sewing or looping, and are constituted generally by a hook-shaped element that can move on command so as to engage the portion of the sewing chain stitch that extends from the last spike of the half-ring that passed in front of the pair of sewing elements, and the sewing elements themselves. A clip and a blade are respectively laterally adjacent to the hook-shaped element and are designed respectively to engage the sewing chain stitch and to cut it.

In this manner, the portion of the sewing chain stitch that is engaged with the article is separated from the sewing or looping head, while the remaining portion of the sewing chain stitch, which extends from the hook-shaped element to the sewing elements, remains clamped, with its end, between the hook-shaped element and the clip.

These sewing or looping heads suffer some drawbacks, which are mainly due to the cutting element that is used.

The arrangement of the cutting element, which is spaced downstream of the sewing elements along the direction of rotation of the half-ring that supports the article during the sewing or looping operation, forces the provision of a portion of sewing chain stitch that is in excess at the end of the sewing portion performed on the article to allow the final end of the sewn portion of the article to face the hook-shaped element so that it can engage the sewing chain stitch in order to cut it. This portion of excess sewing chain stitch is cut by the cutting element at the end of the sewing process proximate to the final end of the sewn portion of the article and, in order to prevent it from being able to remain on the article, at the beginning of a new sewing process when the initial end of the sewn portion of the article passes proximate to the hook-shaped element. In this cut, at the beginning of the new sewing operation, the cutting element is assisted by a suction port, which retains the portion of sewing chain stitch while the hook-shaped element is disengaged and again engaged with the sewing chain stitch portion proximate to the article. This excess sewing chain stitch, which is spaced from the suction port, in case of large productions, is a considerable waste of yarn and therefore constitutes an additional cost.

Moreover, this provision of an excess sewing chain stitch portion, together with the need to rotate, once the sewing operation has ended, the half-ring through an additional arc in order to move the excess sewing chain stitch into a position that is adapted for it to be engaged by the hook-shaped element, inevitably increases the time needed to complete the sewing or looping operation and consequently has a negative effect on the overall time required by the operation for automated closing of the axial end of the article. Moreover, this time increase is worsened by the fact that generally the half-ring, after the cutting element has cut the sewing chain stitch, must be returned to the initial position by means of a rotation in the opposite direction about the axis of the ring.

DISCLOSURE OF THE INVENTION

The aim of the present invention is to solve the problems described above by providing a sewing or looping head particularly for the automated closing of tubular knitted articles at one of their axial ends that allows to reduce significantly the time required by the sewing or looping operation.

Within this aim, an object of the invention is to provide a sewing or looping head that allows to reduce significantly the consumption of yarn in the execution of sewing or looping.

Another object of the invention is to provide a sewing or looping head that has high reliability and precision in cutting the sewing or looping chain stitch.

Still another object of the invention is to provide a sewing or looping head that does not require the use of suction ports.

This aim, as well as these and other objects that will become better apparent hereinafter, are achieved by a sewing or looping head, particularly for the automated closing of tubular knitted articles at one of their axial ends, comprising a pair of sewing elements, which can move along corresponding actuation paths and cooperate with each other in forming a sewing chain stitch, and a cutting element, which can be actuated to cut the sewing chain stitch, characterized in that said cutting element can engage the sewing chain stitch proximate to the crossing point of the paths of said pair of sewing elements or the point where the sewing chain stitch is formed.

BRIEF DESCRIPTION OF THE DRAWINGS

Further characteristics and advantages of the present invention will become better apparent from the description of a preferred but not exclusive embodiment of the sewing or looping head according to the invention, illustrated by way of non-limiting example in the accompanying drawings, wherein.

WAYS OF CARRYING OUT THE INVENTION

Figure 4:
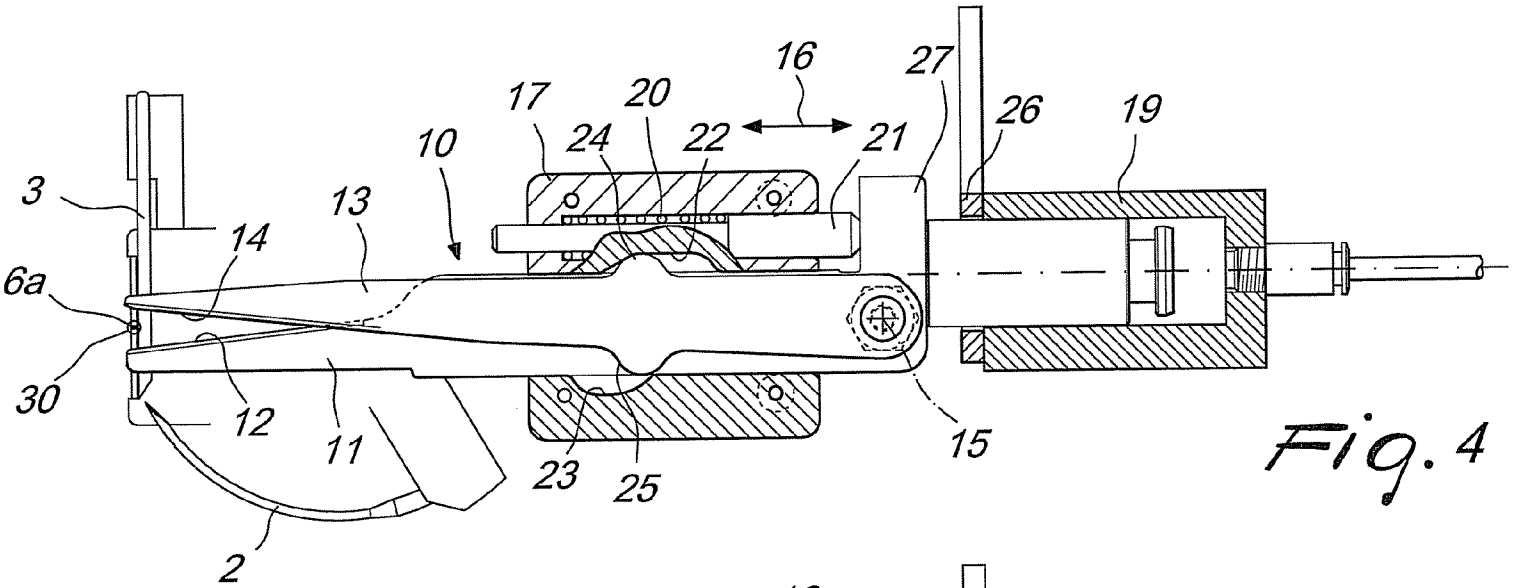
FIG. 4 is a view of a detail of FIG. 2, related to the cutting element, with the cutting element in an intermediate position of operation.
Figure 6:
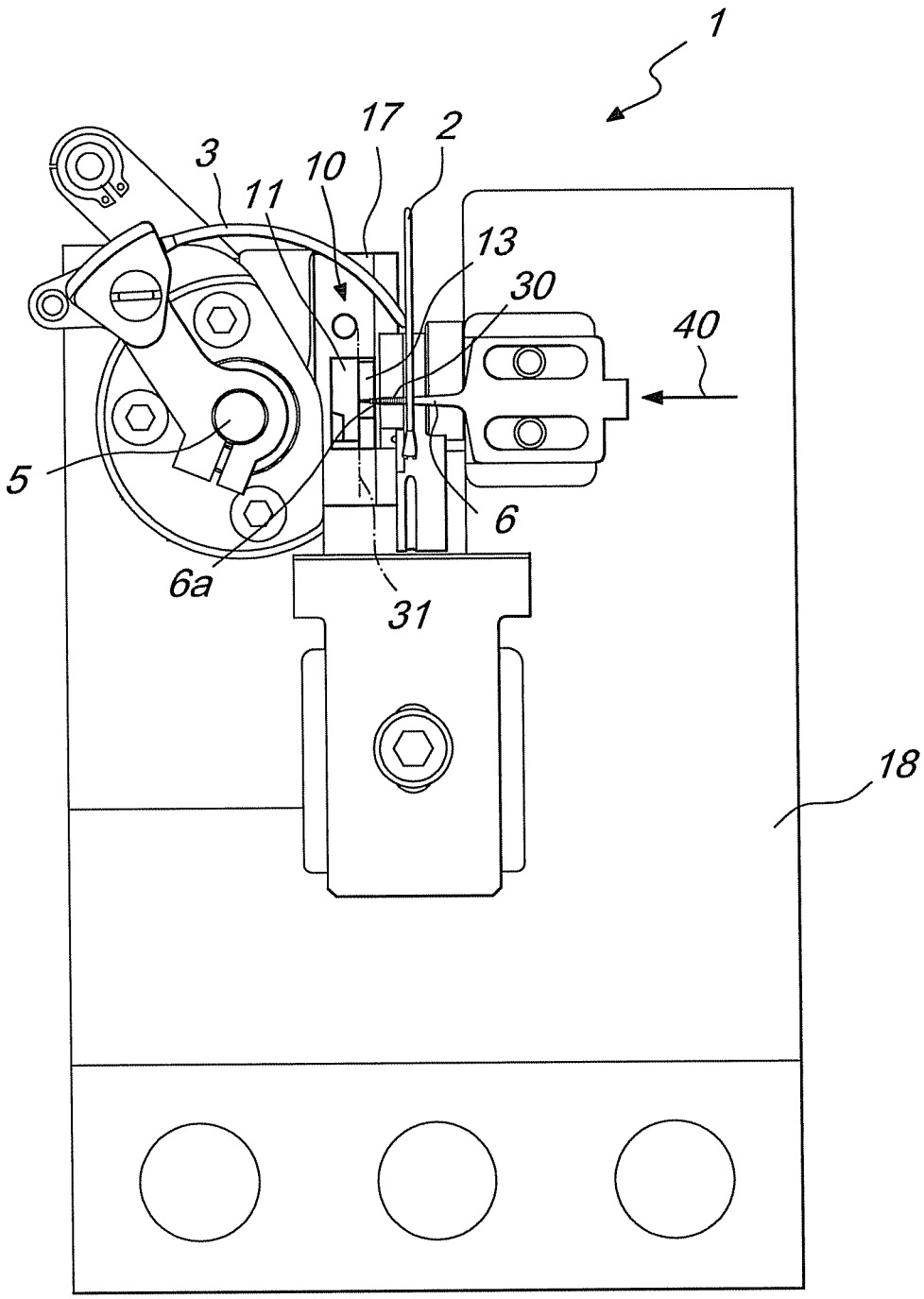
FIG. 6 is a front elevation view of the sewing or looping head according to the invention.

With reference to the figures, the sewing or looping head according to the invention, generally designated by the reference numeral 1, comprises, in a per se known manner, a pair of sewing elements that can move, in a synchronized manner with respect to each other, along corresponding actuation paths and cooperate with each other in forming a sewing chain stitch 30, which is shown schematically in FIGS. 4 and 6. Depending on the type of sewing to be provided, such pair of elements can be constituted by two needles or, as in the illustrated embodiment, by a needle 2 and a crochet 3. With particular reference to the illustrated embodiment, the needle 2 has a curved shape, is provided with an eye proximate to its tip and is threaded with a corresponding yarn. The needle 2 is fixed, by means of its end that lies opposite the tip, to a shaft 4 that can be actuated with an oscillating motion about its own axis. The crochet 3 also has a curved shape, has an eye proximate to its tip and is threaded with a corresponding yarn. The crochet 3 is fixed, by means of its end that lies opposite the tip, to a shaft 5 that can be actuated with an oscillating motion about its own axis and is connected kinematically to the shaft 4 so that the movement of the needle 2 and the movement of the crochet 3 are synchronized with respect to each other.

In practice, the needle 2 is actuated along a path that is arranged on a first actuation plane and the crochet 3 is actuated along a path that is arranged on a second actuation plane that is substantially perpendicular to the first actuation plane. These two paths cross each other and the formation of the sewing chain stitch 30 begins proximate to this crossing point.

Proximate to such crossing point, in a per se known manner, a spear element or hook 6 is provided for supporting the sewing chain stitch 30, the hook being oriented with its tip 6*a* along the advancement direction, indicated by the arrow 40, of the article being sewn or looped. More particularly, the needle 2, in its motion, passes to one side of the hook 6 and is designed to engage cyclically the article that is made to advance along a path that is parallel or tangent to the direction indicated by the arrow 40 and matches the orientation of the tip 6*a* of the hook 6, as will become better apparent hereinafter. The crochet 3, in its motion, passes on the side of the hook 6 that lies opposite the needle 2. In this manner, the sewing chain stitch 30 forms around the hook 6 and, if present, in engagement with the article. The advancement of the article causes the progressive disengagement of the sewing chain stitch 30 from the tip 6*a* of the hook 6.

According to the invention, the sewing or looping head comprises a cutting element 10, which is suitable to engage the sewing chain stitch 30 proximate to the crossing point of the paths of the pair of sewing elements 2 and 3, i.e., proximate to the crossing point of the paths of the needle 2 and of the crochet 3 or proximate to the formation point of the sewing chain stitch 30.

Preferably, the cutting element 10 can engage the sewing chain stitch 30 at a distance from the formation point of the sewing chain stitch 30 that is substantially comprised between 3 mm and 15 mm.

More particularly, the cutting element 10 can engage the sewing chain stitch 30 proximate to the tip 6*a* of the hook 6.

Preferably, the cutting element is scissor-shaped and works on a cutting plane 31 that is substantially perpendicular to the direction 40 along which the tip 6*a* of the hook 6 is oriented.

The cutting plane 31 preferably faces the tip 6*a* of the hook 6 and is arranged at a distance from said tip 6*a* that is comprised substantially between 1 mm and 10 mm.

In practice, the hook 6 is oriented with its tip 6*a* along a direction that is substantially perpendicular to the plane of actuation of the needle 2 and the cutting plane 31, i.e., the plane along which the scissor-shaped cutting element 10 is opened and closed, is substantially parallel to the actuation plane of the needle 2.

The cutting element 10 is substantially composed of a first arm 11, which defines a complementary blade 12, and of a second arm 13, which is supported by the first arm 11 and defines a blade 14 that faces the complementary blade 12. The first arm 11 and the second arm 13 are pivoted to each other proximate to one of their longitudinal ends, which constitutes the opposite end with respect to the tip of the scissors, about a pivoting axis 15. The second arm 13 can rotate with respect to the first arm 11 about the pivoting axis 15, on the plane defined above as "cutting plane", in order to open or close the tip of the scissors.

Figure 5:
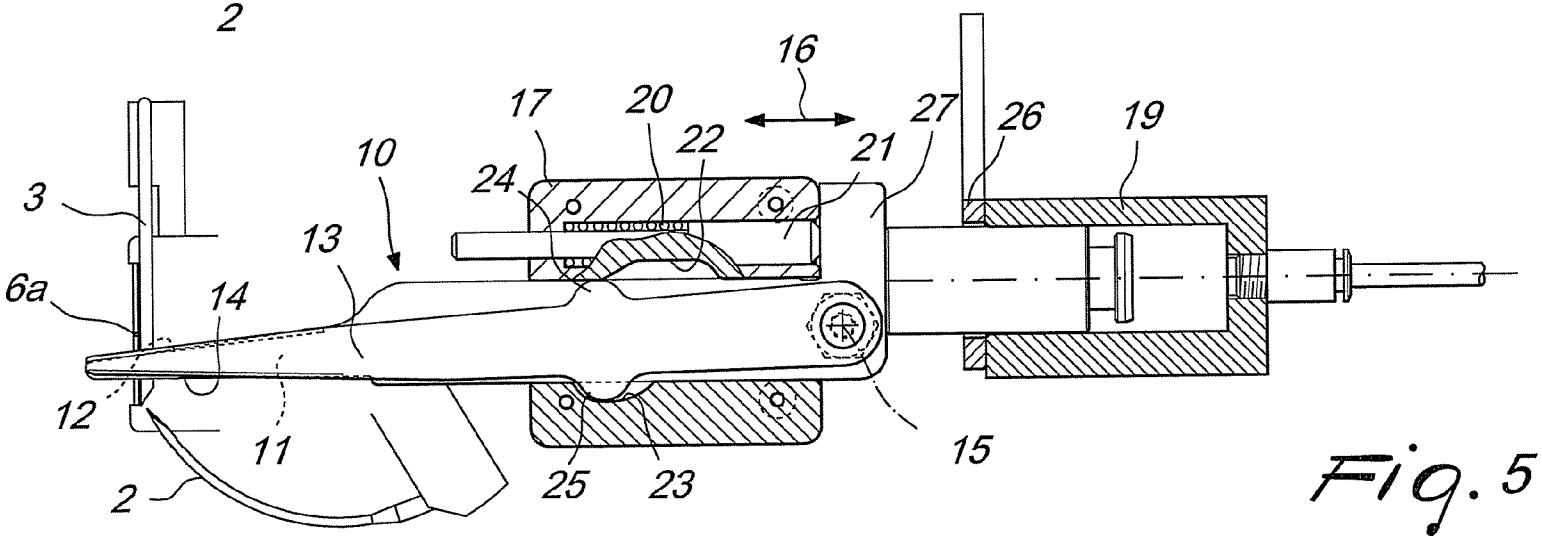
FIG. 5 is a view of the same detail of FIG. 4, with the cutting element in the cutting position.

The first arm 11 is supported, so that it can slide along a sliding direction 16 that is substantially perpendicular to the direction of advancement of the article during sewing or perpendicular to the direction 40, by a supporting block 17, which is associated with the supporting structure 18 of the sewing or looping head being considered. The sewing or looping head comprises first actuation means for performing the controlled movement of the cutting element 10 along the sliding direction 16 from an inactive position, in which it is spaced laterally, with its open tip, from an imaginary line that extends the tip 6*a* of the hook 6, as shown in particular in FIG. 2, to a cutting position, in which it crosses with its tip such imaginary line that extends the tip 6*a* of the hook 6, as shown in particular in FIGS. 4 and 5.

Such first actuation means comprise a fluid-operated cylinder 19, whose body is connected to the supporting structure 18 of the sewing or looping head and which acts with the stem of its piston, which is oriented parallel to the sliding direction 16, on the end of the first arm 11 that lies opposite with respect to the end that constitutes the tip of the scissors. The action of the piston of the fluid-actuated cylinder 19 is contrasted by the action of elastic return means, which are constituted by a spring 20 which, by means of a piston 21, acts on the first arm 11 in the opposite direction with respect to the action of the piston of the fluid-actuated cylinder 19.

Conveniently, second actuation means are provided which act on the second arm 13 of the cutting element 10 to turn it about the pivoting axis 15 with respect to the first arm 11 as a consequence of the movement of the first arm 11 along the sliding direction 16 with respect to the supporting block 17. Such second actuation means comprise at least a cam-like profile, which is jointly connected to the supporting block 17 and can be engaged by a corresponding portion of the second arm 13 that is provided as a cam follower.

In the illustrated embodiment, the second actuation means comprise an upper cam-like profile 22 and a lower cam-like profile 23, which are formed within the block 17 and face two opposite sides of the second arm 13, which has an upper portion 24 that can engage the upper cam-like profile 22 and a lower portion 25, which can engage the lower cam-like profile 23. In practice, during the translational motion of the first arm 11 along the sliding direction 16, during the passage of the cutting element 10 from the inactive position to the cutting position, the upper portion 24 engages the upper cam-like profile 22 which, proximate to the end of this translational motion, causes the rotation of the second arm 13 with respect to the first arm 11 about the pivoting axis 15 so as to close the scissors, while during the opposite translational motion of the first arm 11 along the sliding direction 16 the lower portion 25 engages the lower cam-like profile 23, which causes the rotation of the second arm 13 with respect to the first arm 11 about the pivoting axis 15 in the opposite direction in order to reopen the scissors.

Conveniently, the sewing or looping head according to the invention comprises means for detecting the position of the cutting element 10. More particularly, such means comprise a sensor for detecting the inactive position of the cutting element 10, and such sensor can be constituted simply by a plate 26 made of electrically conducting material, which can be contacted by an electrically conducting region 27 of the first arm 11 when the cutting element 10 is in the inactive position. In practice, the plate and the electrically conducting region of the first arm 11 are arranged along an electrical control circuit which is closed by the contact of these two elements.

Operation of the sewing or looping head according to the invention is as follows.

The article to be sewn or looped is mounted, in a per se known manner, on an appropriately provided supporting element, which is not shown for the sake of simplicity and is provided with a plurality of mutually uniformly spaced spikes, so that each one of such spikes carries a pair of loops of knitting to be joined by sewing or looping. The sewing or looping head 1 is then positioned with respect to the supporting element so that the supporting element is adjacent to the hook 6 on the side thereof that lies opposite the crochet 3. The supporting element on which the article is arranged is then moved along an advancement path that is parallel or tangent to the direction 40 identified by the orientation of the tip 6*a* of the hook 6 with an advancement speed that is correlated to the actuation speed of the needle 2 and of the crochet 3, so that in each instance the needle 2 engages one of the spikes of the supporting element, joining the two loops of knitting arranged on such spike. The combined actuation of the needle 2 and of the crochet 3, as well as the presence of the hook 6, achieves the formation of a sewing chain stitch 30, which is engaged with the article and is wound around the hook 6. It should be noted that the presence of the hook 6 allows to form the sewing chain stitch 30 even in the absence of the article. The progressive advancement of the article along its advancement path achieves the progressive disengagement of the sewing chain stitch 30 from the hook 6.

Figure 1:
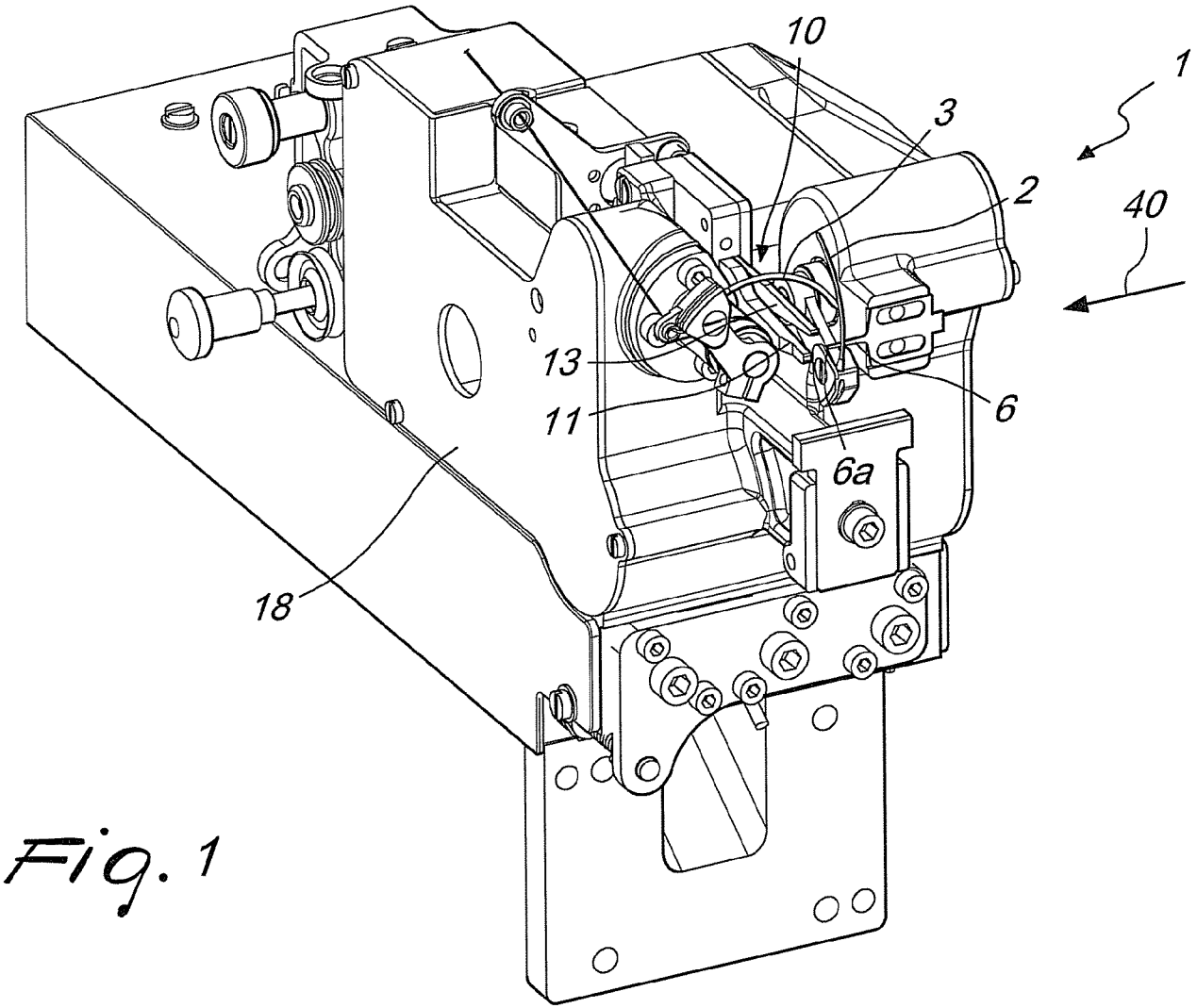
FIG. 1 is a perspective view of the sewing or looping head according to the invention.
Figure 2:
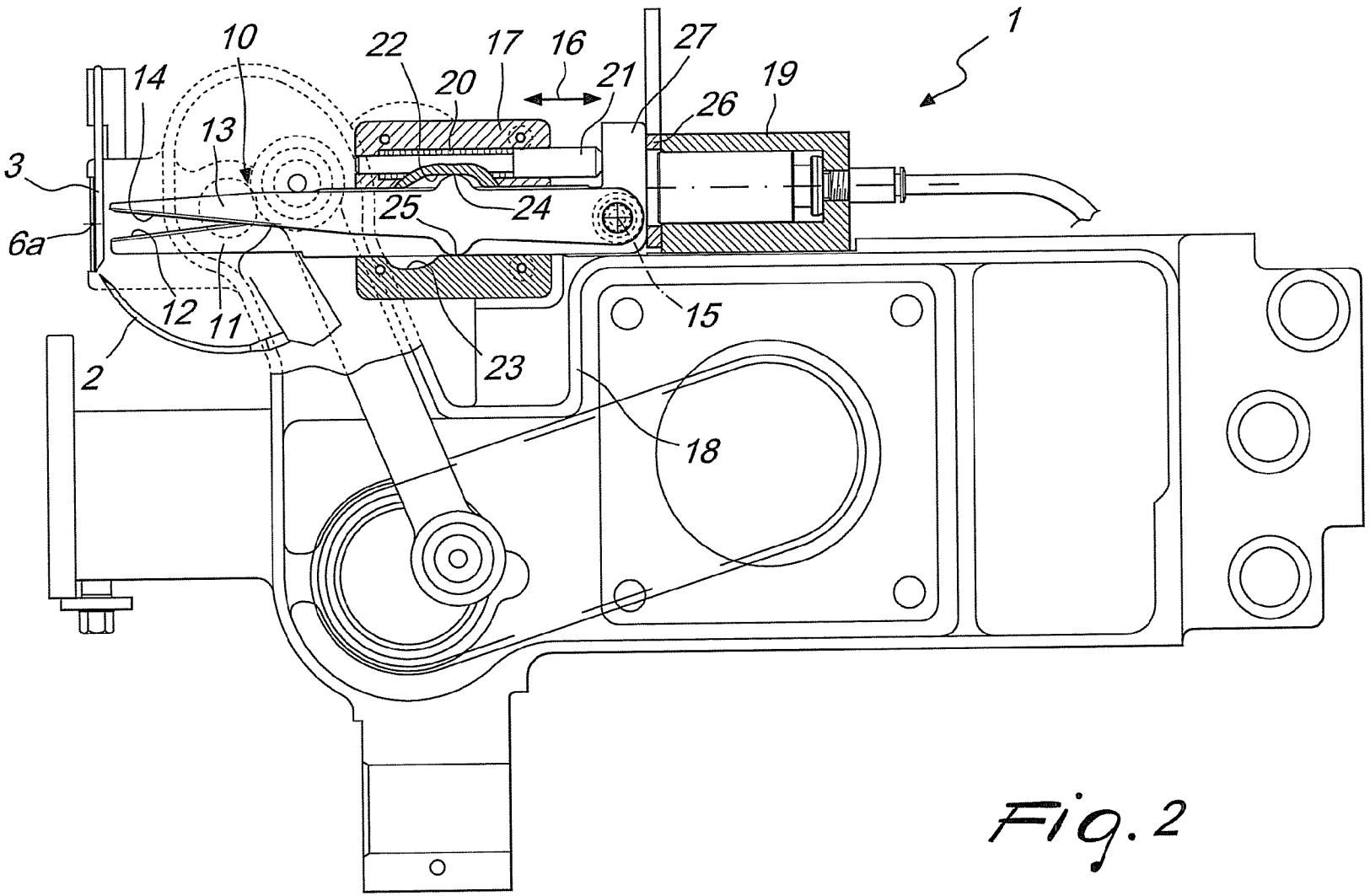
FIG. 2 is a partially sectional side elevation view of the sewing or looping head according to the invention, with the cutting element in the inactive position.
Figure 3:
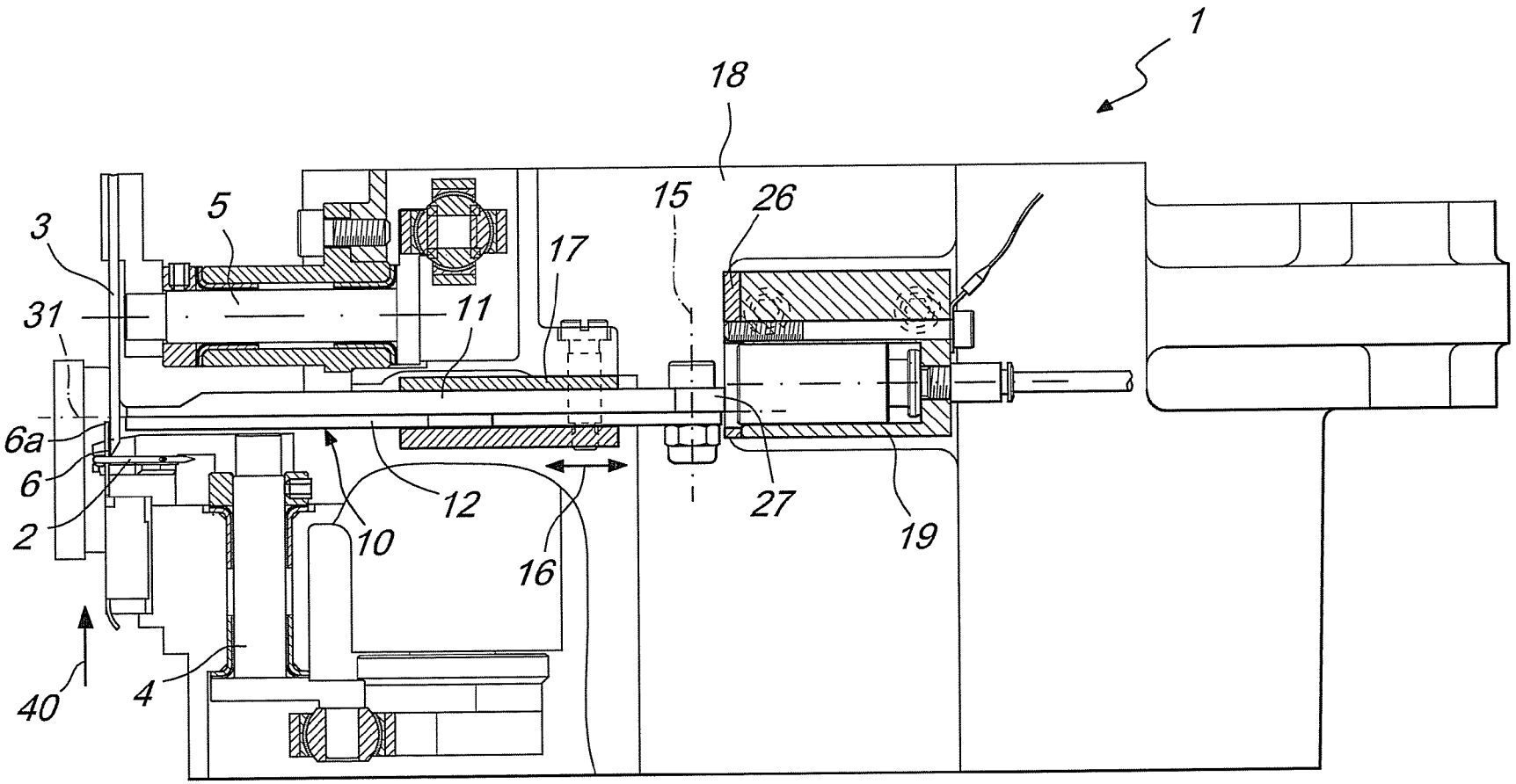
FIG. 3 is a partially sectional top plan view of the sewing or looping head according to the invention, with the cutting element in the inactive position.

During the sewing or looping operation, the cutting element 10 is kept in the inactive position, shown in FIGS. 2 and 3.

At the end of the sewing or looping operation, the fluid-actuated cylinder 19 is activated and causes the transition of the cutting element 10 from the inactive position to the cutting position, simultaneously actuating the advancement of the scissors toward the sewing chain stitch 30 and the closing of the scissors, which achieves in this manner the cutting of the sewing chain stitch 30.

More particularly, during the advancement motion of the first arm 11, the upper portion 24 of the second arm 13 engages the upper cam-like profile 22, which causes the rotation of the second arm 13 with respect to the first arm 11 in the direction for closing the scissors. This rotation is allowed by the presence of the lower cam-like profile 23.

The deactivation of the fluid-actuated cylinder 19 causes, as a consequence of the elastic reaction of the spring, the return of the cutting element 10 to the inactive position and, as a consequence of the coupling of the lower portion 25 of the second arm 13 with the lower cam-like profile 23, the opening of the scissors. In this case, the opening rotation of the second arm 13 with respect to the first arm 11 about the axis 15 is allowed by the presence of the upper cam-like profile 22.

It should be noted that the cutting element 10 cuts the sewing chain stitch 30 in a region that is very proximate to the point where the sewing chain stitch 30 is formed and therefore allows to minimize the excess portion of chain stitch 30 to be produced. Moreover, the stroke of the supporting element of the article being sewn or looped can be equal or only slightly longer than the extension of the article.

In practice it has been found that the sewing or looping head according to the present invention fully achieves its intended aim, since it allows to speed up the sewing or looping operation and to reduce the amount of yarn required to perform sewing.

Although the sewing or looping head according to the invention has been conceived in particular to be used in the automated closure of tubular articles, at one of their axial ends, it can be used advantageously also in other operations for sewing or looping articles mounted on straight supporting elements, annular elements, or semi-annular elements.

The sewing or looping head thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2008A001006 from which this application claims priority are incorporated herein by reference.

The invention claimed is:

1. A sewing or looping head, particularly for the automated closing of tubular knitted articles at one of their axial ends, comprising a pair of sewing elements, which can move along corresponding actuation paths and cooperate with each other in forming a sewing chain stitch, and a cutting element, which can be actuated to cut the sewing chain stitch, wherein said cutting element can engage the sewing chain stitch proximate to the crossing point of the paths of said pair of sewing elements or the point where the sewing chain stitch is formed, and wherein said sewing elements comprise a needle and a crochet which can move along corresponding actuation paths that cross so as to form the sewing chain stitch, a hook being provided for supporting the sewing chain stitch being formed, said hook being arranged proximate to the crossing point of said actuation paths and being oriented so that its tip is directed along the direction of advancement of the article being sewn or looped, said cutting element being engageable with the sewing chain stitch proximate to the tip of said supporting hook of the sewing chain stitch.

2. The sewing or looping head according to claim 1, wherein said cutting element can engage the sewing chain stitch at a distance from the point where the sewing chain stitch is formed that is substantially comprised between 3 mm and 15 mm.

3. The sewing or looping head according to claim 1, wherein said cutting element is scissor-shaped.

4. The sewing or looping head according to claim 1, wherein said cutting element is scissor-shaped and works on a cutting plane that is substantially perpendicular to the direction of orientation of the tip of said supporting hook of the sewing chain stitch.

5. The sewing or looping head according to claim 4, wherein said cutting plane faces the tip of said hook for supporting the sewing chain stitch.

6. The sewing or looping head according to claim 5, wherein said cutting plane is arranged at a distance from the tip of said supporting hook of the sewing chain stitch that is comprised substantially between 1 mm and 10 mm.

7. The sewing or looping head according to claim 4, wherein said needle can move along the corresponding actuation path on a first actuation plane that is substantially perpendicular to the advancement direction of the article being sewn and can engage the article cyclically; said crochet being movable along the corresponding actuation path on a second actuation plane that is substantially perpendicular to said first actuation plane; said cutting plane being substantially parallel to said first actuation plane.

8. The sewing or looping head according to claim 4, wherein said scissor-shaped cutting element has a first arm that defines a complementary blade and a second arm that defines a blade that faces said complementary blade, said first arm and said second arm being pivoted to each other proximate to one of their longitudinal ends that defines the end of the scissors that lies opposite the tip of the scissors, said first arm being able to rotate with respect to said second arm on said cutting plane about a corresponding pivoting axis in order to open or close the tip of the scissors.

9. The sewing or looping head according to claim 8, wherein said first arm of the cutting element is supported, so that it can slide along a sliding direction that is substantially perpendicular to the advancement direction of the article during sewing, by a supporting block that is associated with the supporting structure of the sewing head, first actuation means being provided for actuating said first arm for controlled movement along said sliding direction for the passage of the cutting element from an inactive position, in which it is spaced laterally with the open tip thereof from an imaginary line that extends the tip of said supporting hook of the sewing chain stitch to a cutting position in which the cutting element crosses with its tip said imaginary line that extends the tip of said supporting hook of the sewing chain stitch.

10. The sewing or looping head according to claim 9, comprising second actuation means that act on said second arm of the cutting element to turn it about said pivoting axis with respect to said first arm as a consequence of the movement of said first arm along said sliding direction with respect to said supporting block.

11. The sewing or looping head according to claim 10, wherein said second actuation means comprise at least one cam-like profile that is jointly connected to said supporting block and can engage a portion of said second arm of the cutting element by way of the movement of said first arm with respect to said supporting block along said sliding direction.

12. The sewing or looping head according to claim 9, wherein said first actuation means comprise a fluid-actuated cylinder that acts on said first arm of the cutting element for its movement, along the sliding actuation direction, from said inactive position to said cutting position in contrast with the action of elastic return means.

13. The sewing or looping head according to claim 1, further comprising detection means for detecting the position of said cutting element.

* * * * *